US008348777B2

(12) United States Patent
Ream et al.

(10) Patent No.: US 8,348,777 B2
(45) Date of Patent: Jan. 8, 2013

(54) SPORT LANDING CUSHION AND CONTAINER

(75) Inventors: Gary P. Ream, Centre Hall, PA (US); Frank L. Bare, Salt Lake City, UT (US)

(73) Assignee: Powdr-Woodward PA LLC, Park City, UT (US)

( * ) Notice: Subject to any disclaimer, the term of this patent is extended or adjusted under 35 U.S.C. 154(b) by 376 days.

(21) Appl. No.: 12/361,933

(22) Filed: Jan. 29, 2009

(65) Prior Publication Data

US 2009/0239670 A1 Sep. 24, 2009

Related U.S. Application Data

(60) Provisional application No. 61/025,075, filed on Jan. 31, 2008.

(51) Int. Cl.
*A63C 19/00* (2006.01)

(52) U.S. Cl. ..... 472/92

(58) Field of Classification Search ..... 472/92
See application file for complete search history.

(56) References Cited

U.S. PATENT DOCUMENTS 3,840,922 A * 10/1974 Morrison et al. ..... 482/15
3,851,730 A * 12/1974 Scurlock ..... 182/137
4,819,932 A 4/1989 Trotter, Jr.
4,887,811 A * 12/1989 Tresh ..... 473/451
6,533,671 B2 * 3/2003 Isabelle et al. ..... 472/89
7,244,216 B2 7/2007 Rastegar
2008/0083364 A1 * 4/2008 Taylor ..... 114/360

OTHER PUBLICATIONS

Wikipedia, the free encyclopedia, "Snowboarding", http://en.wikipedia.org/wiki/snowboarding, printed Jan. 10, 2008, 8 pages.
Wikipedia, the free encyclopedia, "Artificial Ski Slopes", http://en.wikipedia.org/wiki/artificial_ski_slopes, printed Jan. 10, 2008, 4 pages.
Wikipedia, the free encyclopedia, "Artificial Turf", http://en.wikipedia.org/wiki/artificial_turf, printed Jan. 10, 2008, 8 pages.
Sportexe, "Our Synthetic Turf Systems", http://www.sprotexe.com/produts.asp, printed Jan. 10, 2008, 1 page.
Outdoor Wilderness Fabrics, Inc., "Cordura", http://www.owfinc.com/fabrics/nylonwoven/cordura.asp, printed Jan. 10, 2008, 4pages.

* cited by examiner

*Primary Examiner* — Michael Dennis
(74) *Attorney, Agent, or Firm* — Snell & Wilmer L.L.P.

(57) ABSTRACT

A sport landing cushion may comprise an airbag comprising first and second inflatable compartments or first and second airbags, wherein the first compartment (airbag) is thicker than the second compartment (airbag) and provides a base, and wherein the second compartment (airbag) provides a landing surface and is for inflation to a higher pressure for use than is the first compartment (airbag). A container therefor may comprise an enclosure for a rolled deflated airbag and having an opening through which a deflated airbag may pass, a winch, and an air supply for inflating the airbag.

21 Claims, 10 Drawing Sheets

SPORT LANDING CUSHION AND CONTAINER

The present Application claims the benefit of the priority of U.S. Provisional Patent Application No. 61/025,075 filed Jan. 31, 2008, which is hereby incorporated herein by reference in its entirety.

The present invention relates to a landing cushion and a container, and, in particular, to a sport landing cushion wherein the cushion is inflatable and stowable in the container.

In extreme sports, very difficult and dangerous maneuvers and acrobatics, particularly aerial maneuvers and aerial acrobatics, are attempted and, as a result, the performer thereof is in danger when returning to earth if his or her landing is not proper. Classic examples of potentially disastrous landings and of landings producing injury have been shown on television along with the commentary "the agony of defeat."

Extreme sports are performed on skis, snowboards, skateboards, bicycles, motorcycles, skates, and possibly other devices, at great risk of injury to participants, including severe injury or possibly death. It is noted that this danger is likely greater where a person is trying to learn how to perform such maneuvers and acrobatics or is not highly skilled in performing same. Yet, the danger and risk doesn't seem to dissuade some persons from attempting such feats, but may be part of the attraction to attempt such feats. In certain quarters, extreme sports are developing into professional sports and even Olympic sports. In snowboarding, extreme aerial maneuvers may be referred to as aerial or jib tricks, and may be launched from, e.g., rails, boxes, jumps, half pipes, quarter pipes and a myriad of other features Thus, it would be desirable to have a landing area wherein the risk to the performer is reduced from the risk of landing on snow, ice or earth.

Accordingly, there is a need for a landing cushion that could provide a more forgiving landing surface than does a natural surface. It would also be desirable if such landing cushion could be stored in a storage container when not in use.

To this end, a sport landing cushion may comprise an airbag comprising first and second inflatable compartments, wherein the first compartment is thicker than the second compartment and provides a base, and wherein the second compartment provides a landing surface and is for inflation to a higher pressure for use than is the first compartment.

In another aspect, a landing cushion container may comprise an enclosure sufficient to enclose a roller having a deflated airbag rolled thereon and having an opening through which a deflated airbag may pass; a winch for assisting in moving the airbag into the enclosure; and an air supply for inflating the airbag when the airbag is not in the enclosure.

BRIEF DESCRIPTION OF THE DRAWING

The detailed description of the preferred embodiment(s) will be more easily and better understood when read in conjunction with the FIGURES of the Drawing which include.

Figure 1A:
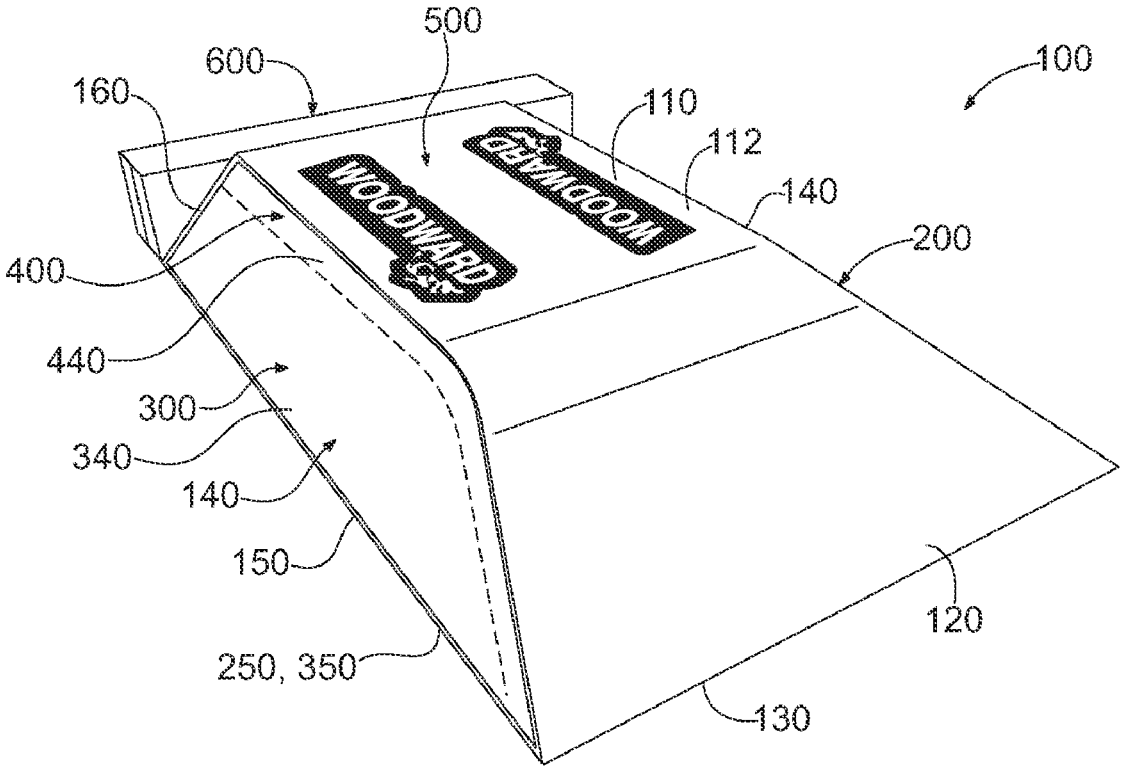
FIG. 1A is an isometric view of an example embodiment of a sport landing cushion wherein the cushion is inflated.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing and with similar nomenclature in the specification. It is noted that, according to common practice, the various features of the drawing are not to scale, and the dimensions of the various features are arbitrarily expanded or reduced for clarity, and any value stated in any Figure is given by way of example only.

DESCRIPTION OF THE PREFERRED EMBODIMENT(S)

Figure 1B:
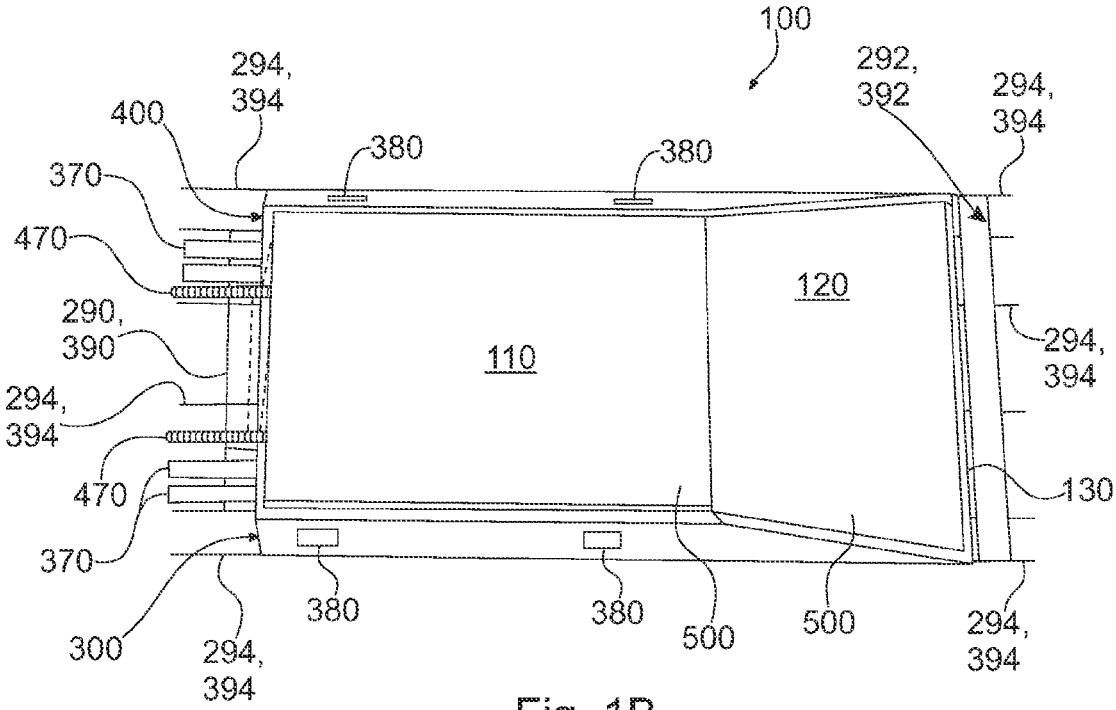
FIG. 1B is a top view of the example landing cushion of FIG. 1 illustrating various connections thereto and features thereof.

FIG. 1A is an isometric view of an example embodiment of a sport landing cushion 100 wherein the cushion is inflated, e.g., for use as a landing cushion, and FIG. 1B is a top view of the example landing cushion 100 of FIG. 1 illustrating various connections thereto and features thereof. Landing cushion 100 includes a top or landing surface 110 having a generally rectangular main portion 112 and a sloped ramp portion 120 leading to a ramp exit 130. Landing cushion 100 has a base 140 which rests upon the earth, floor or other support for cushion 100. Opposing sides 140 extend between base 140 and top and ramp portions 110, 120, and may preferably be sloped slightly inward so that top surface 110 is slightly narrower than is base 140. End 160 completes cushion 100 at the end thereof adjacent container 600 into which cushion 100 may be moved, e.g., for storage. Thus, in a preferred arrangement, ramp portion 120, sides 140 and end 160 are generally trapezoidal, and top portion 112 and base 150 are generally rectangular.

Landing cushion 100 comprises an airbag 200 including two compartments 300, 400, e.g., a lower or base compartment 300 and an upper or landing surface compartment 400. Airbag 200 has a top 210, ramp portion 220, sides 240, base 250 and end 260 of size and shape corresponding to that of landing cushion 100. Base compartment 300 thereof preferably comprises the majority of the height of airbag 200 and has a top 310, ramp portion 320, sides 340, base 350 and end 360 of size and shape corresponding to that of a lower portion of landing cushion 100. Landing surface compartment 400 thereof preferably comprises only a small portion of the height of airbag 200 and has a top 410, ramp portion 420, sides 440, base 450 and end 460 of size and shape corresponding to that of landing cushion 100 and airbag compartment 300.

It is noted that airbag 200 may comprise a unitary airbag 200 having compartments 300, 400 defined therein by internal walls and/or baffles, or may comprise two separate airbags 300, 400 that are adjacent to each other to provide the airbag 200. In the latter arrangement, airbags 300, 400 may be detachably attached to each other or may be permanently attached to each other. Where airbags 300, 400 are detachably attached, the detachable attachment may be provided by adhesives, hook and loop fasteners, snaps, ties or any other suitable means, however, hook and loop fasteners thought to be preferable. Herein, the terms airbag and compartment are used interchangeably and equivalently, and so any embodiment may comprise a unitary airbag 200 with compartments 300, 400 or may comprise an airbag 200 comprising separate airbags 300, 400, whichever may be desired.

In a preferred use arrangement, airbag compartment 300 is inflated to a relatively lower pressure so as to be relatively soft and to provide substantial give when a sport participant lands upon cushion 100. In this preferred use arrangement, airbag compartment 400 is inflated to a relatively higher pressure so as to be relatively stiff and to provide substantial support and load spreading when a sport participant lands upon cushion 100, so that the participant or his equipment (e.g., skis, snowboard, skateboard, bicycle, etc.) do not sink into cushion 100 and become captured or stuck therein, as they would be if a soft cushion were to be utilized.

This combination of a stiffer upper airbag 400 and a softer lower airbag 300, e.g., a higher pressure upper airbag 400 and a lower pressure lower airbag 300, desirably cooperate to provide a landing surface 110 upon which a participant can land safely and then proceed off via ramp 120 while providing cushioning to reduce impact forces and stress upon landing, which is particularly desirable for those occasions wherein the participant does not land in a desired manner. While cushion 100 cannot prevent failed landings and cannot prevent injury, it can reduce the likelihood of injury for both successful and failed landings.

A landing surface member 500 of like size and shape to top 210, main portion 212 and ramp portion 220 of cushion airbag 200 is disposed thereon, e.g., to provide a wear surface upon which participants in sport may land, and ski or ride off cushion 100. Storage container 600 provides an enclosure into which cushion 100 may be moved for storage, and includes utilities useful in the operation and stowing of cushion 100, as described below.

In use, a performer's equipment, e.g., skis, snowboard, bicycle, skate, skateboard, or the like, and/or the performer, impacts landing cushion 100 on semi-flexible landing surface member 500 which "gives" slightly in response to impact and transmits the impact load to relatively stiffer airbag (compartment) 400 which further absorbs impact and spreads the impact load to relatively softer airbag (compartment) 300 which substantially cushions and absorbs the impact. Preferably airbag (compartment) 300 has one or more openings or vents through which air can escape relatively quickly in response to the impact of the performer's landing, thereby to substantially cushion the performer's landing.

In FIG. 1B, various connections to airbag 200 are illustrated, including, e.g., flexible tubes 370 for ducting air from an air supply into compartment 300 (airbag 300) and flexible tubes 470 for ducting air from an air supply into compartment 400 (airbag 400). Flexible tubes 370 are typically of a relatively larger diameter for carrying a relatively larger volume of air at a relatively lower pressure into softer cushioning airbag 300, and flexible tubes 470 are typically of a relatively smaller diameter for carrying a relatively smaller volume of air into stiffer landing surface compartment 400 (landing airbag 400).

In one example embodiment, cushion airbag 300 (compartment 300) employs four flexible tubes for carrying air into airbag 300 and stiffer airbag 400 employs two flexible tubes 470 for carrying higher pressure air into airbag 400. Subcompartments and internal framework within airbags 300, 400 may be defined, e.g, by internal walls or baffles that provide a framework for shaping airbags 300, 400 to maintain the desired shape and a uniform height and thickness, and optionally may divide the interior volume of compartments 300, 400 (airbags 300, 400). In the case of compartment 300 (airbag 300), four vents 380 are provided so that air can escape relatively quickly thereby to provide a softer cushioning effect. Internal baffling and framework is preferably of a mesh material that does not impede airflow within airbags 300, 400. Vents 380 may be flaps covering openings, or may be screens or louvers for providing a predetermined area of opening.

In that example embodiment, cushion 100 has a base 150 that is about 50 feet (about 15.2 meters) wide and about 70 feet (about 21.3 meters) long, and has a top 110 that is about 40 feet (about 12.2 meters) wide at container end 160 and about 70 feet (about 21.3 meters) long, with an about 40 foot by 45 foot (about 12.2 meters by 13.7 meters) top area 110 and an about 40 foot (about 12.2 meters) by 25 foot (about 7.6 meters) ramp 120 that is about 50 feet (about 15.2 meters) wide at exit 130. Cushion 100 is about 7 feet (about 2.1 meters) high, with base airbag 300 being about 6½ feet (about 2 meters) high and with airbag 400 being about 6 inches (about 15 cm) high (thick). Vent flaps 380 are about 3 foot by 4 foot (about 0.9 by 1.5 meters) in size, with two vents 380 spaced apart on each side 340. In use, airbag 400 may be inflated to a pressure of up to about 35 pounds per square inch (psi) and airbag 300 may be inflated by air that flows through and out via vents 340 so that internal pressure may be less than about 15 psi. In a typical usage, e.g, for having snowboarders land thereon, airbag 400 may be maintained at about 15-35 psi. Landing surface member 500 is of like size and shape to the top of airbag 200, 400, e.g., it has a top 110 that is about 40 feet (about 12.2 meters) wide at container end 160 and about 70 feet (about 21.3 meters) long, with an about 40 foot by 45 foot (about 12.2 by 13.7 meters) top area 110 and an about 40 foot by 25 foot (about 12.2 by 13.7 meters) ramp 120 that is about 50 feet (about 15.2 meters) wide at exit 130.

Airbag 200, 300, 400 may be constructed of a durable, all-weather vinyl material and/or of a durable fabric, such as a urethane or polyester coated nylon fabric or a laminated fabric, or a CORDURA® fabric, or of another suitable material, with sewn, taped and sewn, heat welded, ultrasonic welded, or other seams, or with a combination of such seams. Airbag 200, 300 may have a plurality of optional reinforcing straps on base 250, 350 thereof, e.g., of six-inch wide webbed strapping, which also may assist in the rolling of airbag 200 in certain arrangements. Optional flaps 292, 392, 294, 394 may be provided at opposing ends of airbag 200 for assisting with the moving thereof. Optional flap 290, 390 may be employed for fastening the container end 260, 360 within container 600, 600' and flap 292, 392 at exit ramp 130 may be utilized in one alternative for moving cushion 100 into container 600'.

Landing surface member 500 may be of any suitable relatively thin material having surface characteristics suitable for the particular sport for which landing cushion 100 is intended, e.g., characteristics that approximate the natural surface on which the sport of interest is conducted. An artificial "dry"

sport surface or turf, such as a type NF75 artificial turf material having textured nylon "grass" and a foam backing with felt as is available from Synthetic Turf International, is thought to be suitable, e.g., where landing cushion 100 is intended to be used with skis or snowboards. An artificial "dry" ski slope surface or other sports surface or turf, such as an ASTROTURF® artificial turf material, is also thought to be suitable, e.g., where landing cushion 100 is intended to be used with skis or snowboards, and possibly with wheeled sport equipment, such as bicycles, motorcycles, skates and skateboards. It is thought that a thinner backing could facilitate to rolling of landing surface 500, particularly in colder environments, e.g., by employing an about 3-mm (about 0.12 inch) foam backing in place of an about 7-mm (about 0.28 inch) foam backing.

Artificial turf is slippery enough to allow the skis and snowboards to slide, while having enough resistance to allow turning and stopping, so that the performer can have a reasonable degree of control. While relatively thin, e.g., as compared to landing surface airbag 400, artificial turf is stiff enough (semi-rigid) that skis and snowboards, and bicycles, motorcycles, skates and skateboards, will not sink into it and catch or grab, which could increase the likelihood of falls and/or injury. A solid polyethylene sheet, high molecular weight solid polyethylene sheet, or other suitable semi-rigid material, for landing surface member 500 may be appropriate for wheeled sport equipment, such as bicycles, motorcycles, skates and skateboards.

Figure 2A:
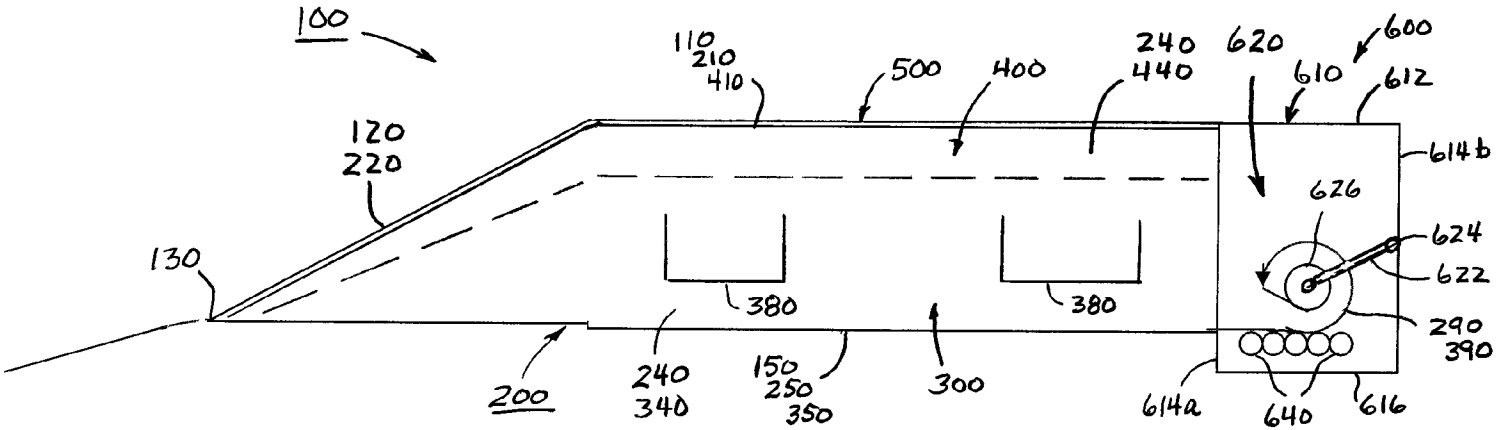
FIGS. 2A, 2B and 2C are side view schematic diagrams of the landing cushion of FIGS. 1A-1B in inflated, deflated and partially rolled states, respectively, with an example container therefor.
Figure 2B:
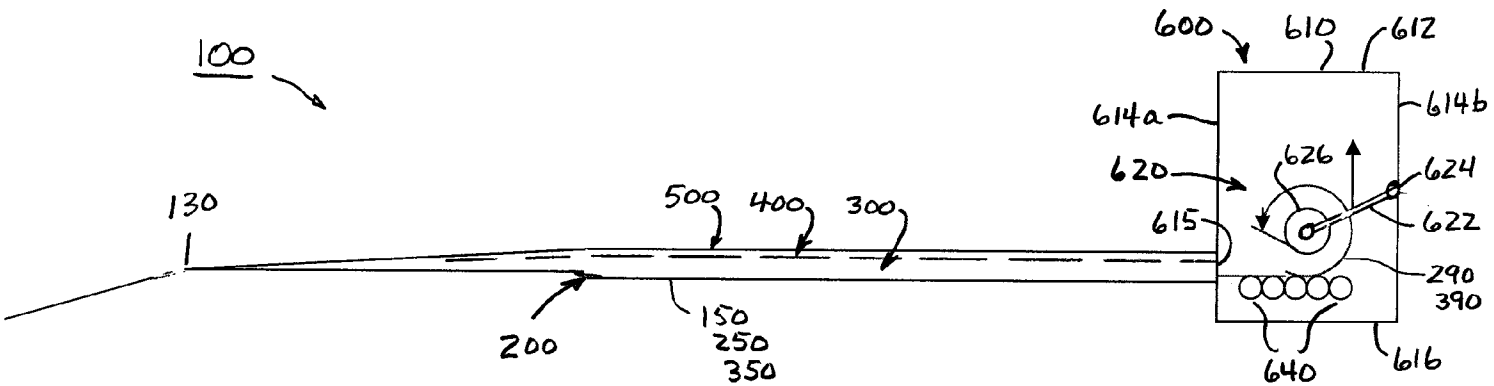
Figure 2C:
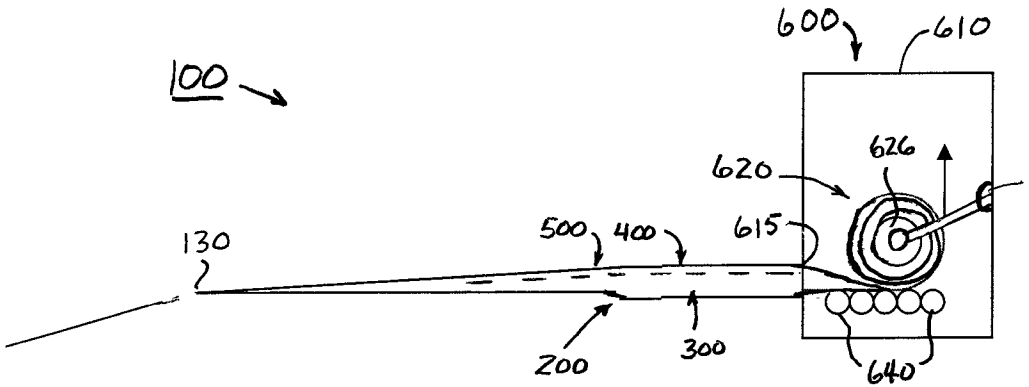
Figure 3:
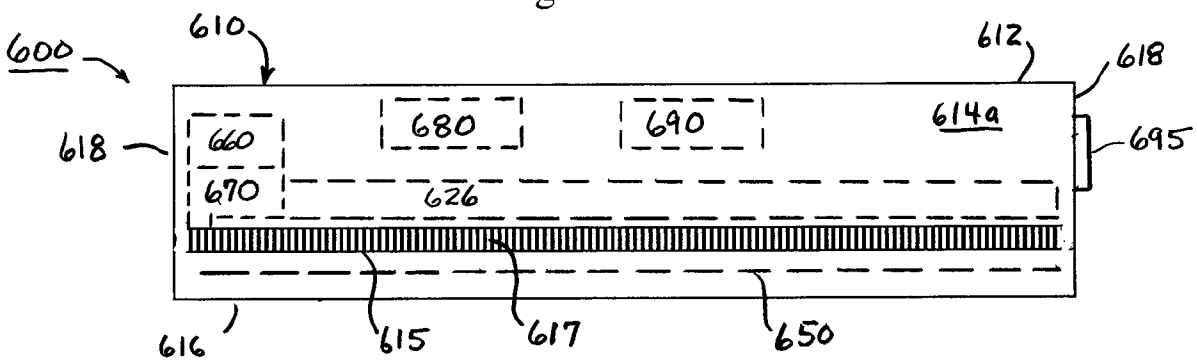
FIG. 3 is a schematic diagram of an example embodiment of a container into which the cushion of FIGS. 1A-1B and 2A-2B may be moved.

FIGS. 2A, 2B and 2C are side view schematic diagrams of the landing cushion 100 of FIGS. 1A-1B in inflated, deflated and partially rolled states, respectively, with an example container 600 therefor, and FIG. 3 is a schematic diagram of an example embodiment of container 600 into which the cushion 100 may be moved. Certain features of cushion 100, e.g., flexible tubes 370, 470 and web straps 294, 394, are not shown for the sake of simplicity.

In this arrangement, landing cushion 100 may be stored by being deflated and then being moved into container 600 by being wound onto or wrapped around a spool 626 or roller 626 therein, e.g., the rotation of spool 626 retracts landing cushion 100 into container 600 as landing cushion winds or wraps around spool 626. Landing cushion 100 may be moved out of container 600 by pulling it out of container 600 so that it unrolls or unwraps from spool 626 in similar manner to the pulling of a window shade from its roller and, once unrolled, landing cushion 100 may be inflated for use.

A possible advantage of this arrangement is thought to be that a single operator may be able to operate container 600 and the apparatus 620-690 therein from a control panel, e.g., a control panel 695 mounted on container 600 or connected thereto by a control cable, for moving landing cushion 100 into container 600, although additional personnel may be desirable for monitoring the operation and watching for safe operation.

In FIG. 2A, landing cushion 100 is illustrated as being inflated, e.g., with both of compartments/airbags 300, 400 being inflated, with airbag 400 being attached on top of airbag 300 and with landing surface member 500 being attached on top of airbag 400, and with the end 260, 360, 460 of airbag 200, 300, 400 adjacent to container 600. In this configuration, landing cushion 100 is ready for use. End flap 290, 390 of airbag 200, 300 extends into container 600 and is attached to take-up roller or spool 626 therein, e.g., by one or more clamps, bolts, hook and loop fasteners, or any other suitable fastener arrangement. In this arrangement, optional flap 292, 392 is not needed and may be omitted.

Container 600 comprises an enclosure 610 having a top panel 612, a base panel 616, a front panel 614*a* having an opening 615 through which deflated cushion 100 may be moved, a rear panel 614*b*, and end panels 618. Container 600 further comprises a roll up arrangement 620 for moving deflated cushion 100 into container 600 and onto a roller or spool 626 therein, and preferably includes various additional apparatus and utilities 650-695 for landing cushion 100, e.g., for inflating airbag 200, 300, 400, and for moving deflated airbag 200, 300, 400 into container 600.

In FIG. 2B, cushion 100 is illustrated in a deflated condition, which could be either preceding the retraction (moving) of cushion 100 into container 600 or following the extraction (moving) of cushion 100 out of container 600. Roll up arrangement 620 for moving landing cushion 100 into container 600 comprises plural rollers 640 that support the weight of the portion of cushion 100 that is inside of container 600 and the weight of take-up roller or spool 626 onto which cushion 100 is rolled or would be rolled.

The opposing ends of spool 626 are preferably rotatably supported at the respective ends of a pair of pivoted arms 622 that may be attached to respective hinges or pivots 624 that may be mounted to rear panel 614*b* or to another suitable member of enclosure 610. As spool 626 is rotated and deflated cushion 100 is drawn into container 600 and is wound around spool 626, the diameter of the rolled cushion 100 on spool 626 increases and pivot arm 622 pivots to allow spool 626 to move upward with cushion 100 and spool 626 supported on rollers 640.

It is noted that because the weight of spool 626 and any of landing cushion 100 wound thereon are supported by rollers 640, cushion 100 tends to be compressed between spool 626 and rollers 640 which tends to press the air out of airbag 200, 300, 400 which is thought to naturally aid in providing a compact storage. The air in airbag 200, 300, 400 is preferably expelled therefrom prior to its being moved into container 600, which tends to be aided by the weight of airbags 200, 300, 400 and landing surface member 500.

In FIG. 2C, cushion 100 is illustrated in a deflated condition and partially rolled onto roller 626 in enclosure 600, which could be either in the process of retracting (moving) cushion 100 into container 600 or in the process of extracting (moving) cushion 100 out of container 600. It is seen that landing cushion 100 has moved into container 600 and onto spool 626 which has moved vertically upward from its position in FIG. 2C as it is rotated to wind cushion 100 thereon. Container 600 is of sufficient size that all of cushion 100 wound around spool 626 fits therein.

Further features of container 600 are apparent from FIG. 3. Opening 615 in front panel 614*a* optionally has a brush 617 thereon for brushing snow and/or other unwanted material from cushion 100 as it is moved into container 600 by being wound around spool 626 therein. Brush 617 may be along the top edge of opening 615, along the bottom edge of opening 615, or along both.

Various apparatus and utilities 620-695 may preferably be provided in container 600. Spool 626 is preferably the spool of a winch. While such winch could be manually operated, it is preferred that the winch include a motor 660 by which spool 626 is rotated. Motor 660, preferably an electric motor, is coupled to spool 626 for causing spool 626 to rotate in the desired direction, whereby motor 660 and spool 626 comprise a winch. Preferably, motor 660 is coupled to spool 626 by a gear arrangement 670 that reduces the speed of rotation of motor 660 while increasing the torque at spool 626 for winding cushion 100 onto spool 626. Alternatively, a manual drive such as a crank could be employed to rotate spool 626 via gear arrangement 670 for moving cushion 100 into container 600, either without a motor 660 to assist or in conjunction with a motor 660.

Typically, landing cushion 100 is deployed, i.e. is unrolled from spool 626 and is moved out of container 600, by pulling it through opening 615, e.g., by a tug, by a tractor, by a snowmobile, by manual labor, or by any other suitable method, and assistance thereto may be provided by the winch wherein spool 626 is rotated in the appropriate direction.

Also included in container 600 are optional air supply 680 for inflating cushion 100, and such air supply 680 may include one or more relatively higher volume lower pressure blowers for inflating relatively softer airbag 300 (compartment 300) via flexible tubes 370, and may include one or more relatively higher pressure air compressors for inflating relatively stiffer airbag 300 (compartment 400) via flexible tubes 470. Preferably, air supply 680 may provide air at controlled pressures and controlled temperatures, e.g., at a temperature above freezing (32° F., 0° C.) so as to reduce the accumulation of snow and/or ice on landing surface member 500, and/or to tend to keep the materials of airbag 200, 300, 400 and of landing surface member 500 relatively flexible. Container 600 may also include an optional heater 650 for raising the temperature in the interior of container 600 above freezing and/or maintaining the interior thereof above freezing, thereby to prevent any moisture from freezing, such as might result from residual snow and/or ice and/or rain that happens to be on landing cushion 100.

While any or all of the foregoing apparatus and utilities 620-690 may be operated from an external source of power, e.g., electrical power from utility supply mains or from an external generator, it is preferred that an optional electrical generator powered by an internal combustion engine be included in container 600. With that arrangement, container 600 and landing cushion 100 are completely movable/portable and do not require connection to any external infrastructure in order to operate.

All of the foregoing apparatus and utilities 620-690 may be mounted on or to enclosure 610 of container 600 in any convenient location and manner. In one example, a shelf near the top of rear panel 614*b* may be employed for mounting heater 650, motor 660, gear arrangement 670, air supply 680 and/or electrical generator 690. Alternatively, heater 650 may be located near base (bottom) panel 616 or may comprise separate heaters located in desired locations within enclosure 610. Motor 660 and/or gear arrangement 670 may be mounted at an end of spool 626, or may be connected thereto by a flexible shaft, a drive belt, a drive chain, or any other suitable arrangement. Certain features of container 600, e.g., air supply tubes, electrical cables, and the like, are not shown for the sake of simplicity.

In an example enclosure 600 suitable for use with landing cushion 100 that is about 50 feet (about 15.2 meters) wide and 70 feet (about 21.3 meters) long at its base 150, container 600 may be about 53 feet (about 16.2 meters) wide, about 8.5 feet (about 2.6 meters) high and about 8 feet (about 2.4 meters) from front to back. Opening 615 may be about 51-52 feet (about 15.5-15.8 meters) wide by about 18 inches (about 46 cm) high. Therewith, airbag 200, 300 has a flap 290, 390 extending from container end 260, 360 that is about 50 feet (about 15.2 meters) wide and about 5 feet (about 1.5 meters) long, and flexible tubes 370, 470 may be about 12 feet (about 3.7 meters) and 8 feet (about 2.4 meters) long, respectively. Straps 294, 394 are typically about 4 inches (about 10 cm) wide and extend about 12 feet (about 3.7 meters) beyond container end 160 of airbag 200, 300.

Figure 4A:
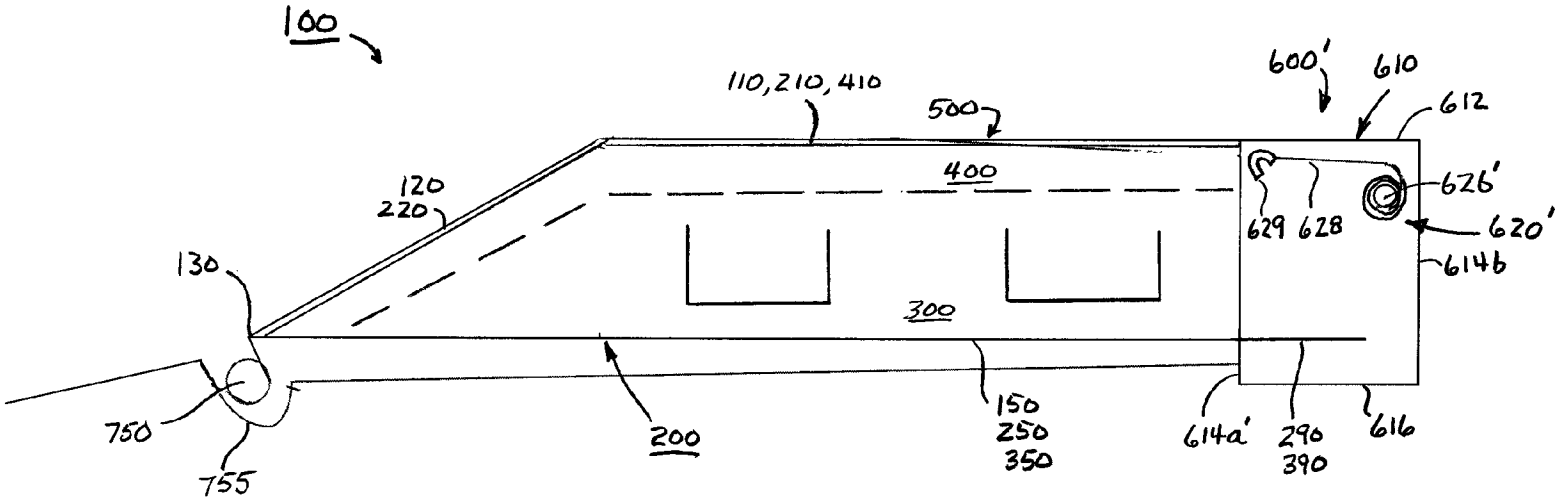
FIGS. 4A, 4B and 4C are side view schematic diagrams of the landing cushion of FIGS. 1A-1B in inflated, deflated and partially rolled states, respectively, with an example container therefor.
Figure 4B:
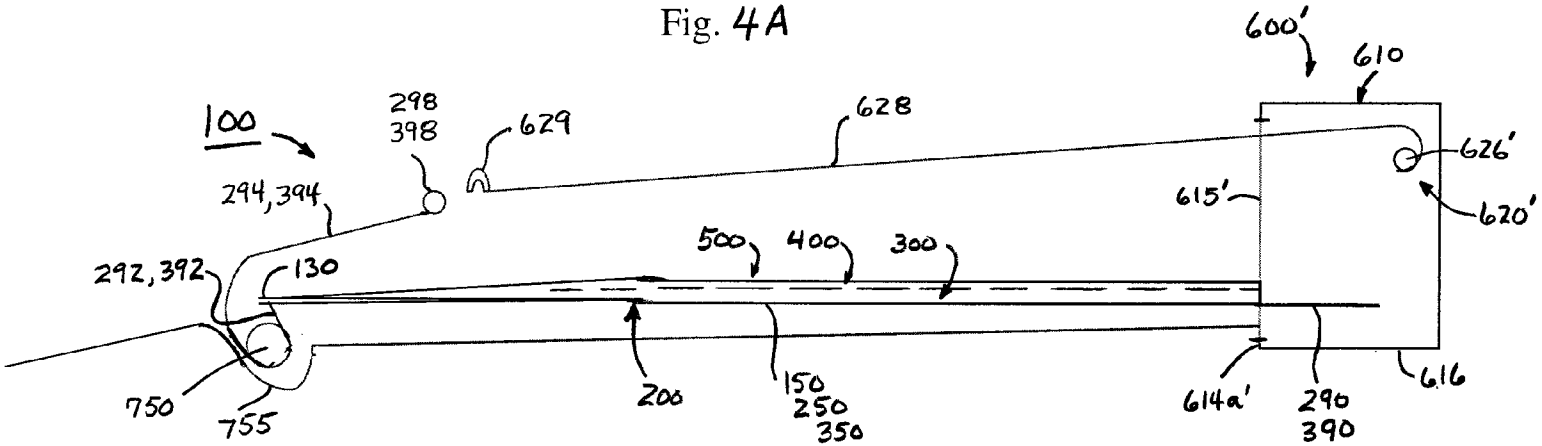
Figure 4C:
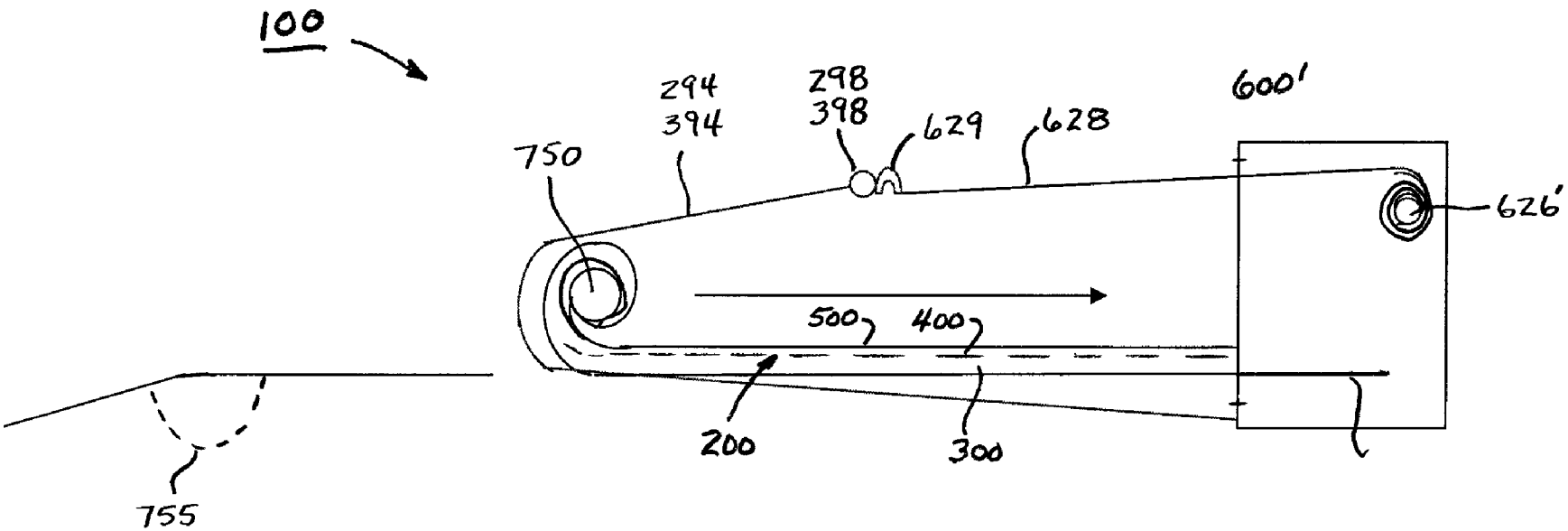
Figure 5:
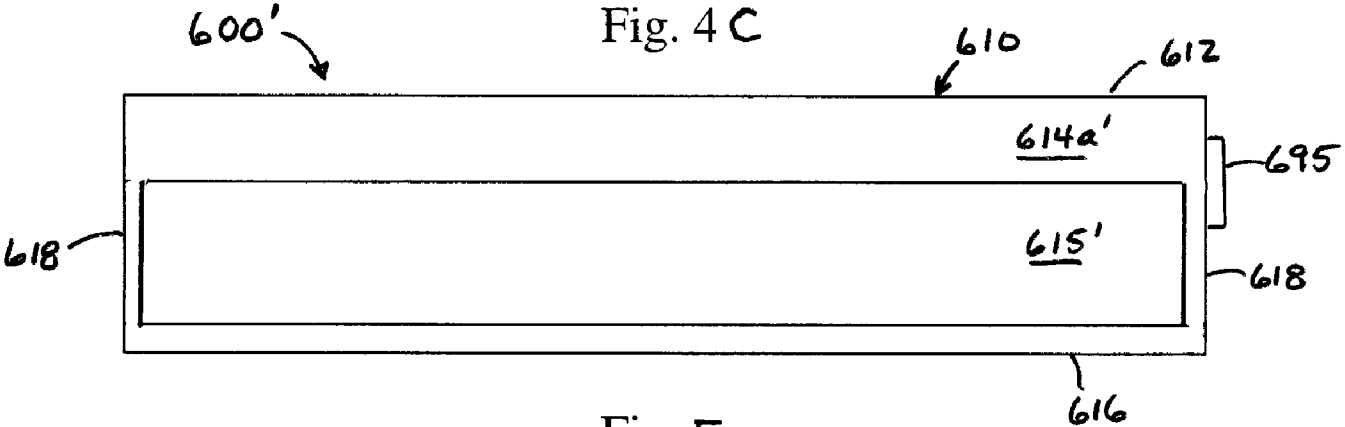
FIG. 5 is a schematic diagram of an example embodiment of a container into which the cushion of FIGS. 1A-1B and 4A-4C may be moved.

FIGS. 4A, 4B and 4C are side view schematic diagrams of the landing cushion 100 of FIGS. 1A-1B in inflated, deflated and partially rolled states, respectively, with an example container 600' therefor, and FIG. 5 is a schematic diagram of an example embodiment of container 600' into which cushion 100 may be moved. Certain features of cushion 100, e.g., flexible tubes 370, 470 and web straps 294, 394, are not shown for the sake of simplicity.

In this arrangement, landing cushion 100 may be stored by being deflated and then being moved into container 600' by being rolled onto a roller 750 starting from its exit end 130 and the entire roll of roller 750 with landing cushion 100 thereon is rolled into container 600'. Landing cushion 100 may be moved out of container 600' by rolling it out with roller 750 in similar manner to the unrolling of a carpet and, once unrolled, landing cushion 100 may be inflated for use, e.g., using one or more air blowers and compressors contained in container 600'.

A possible advantage of this arrangement is thought to be that a single operator may be able to operate container 600' and the apparatus 620'-690 therein from a control panel, e.g., a control panel 695 mounted on container 600' or connected thereto by a control cable, for moving landing cushion 100 into container 600', although additional personnel may be desirable for monitoring the operation and watching for safe operation.

In FIG. 4A, landing cushion 100 is illustrated as inflated, e.g., with both of compartments. airbags 300, 400 inflated, with the end 260, 360, 460 adjacent to container 600'. In this configuration, landing cushion 100 is ready for use. End flap 290, 390 of airbag 200, 300 extends into container 600' through coverable opening 615' and is attached to the interior of container 600', e.g., by one or more clamps, bolts, hook and loop fasteners, holes, holes with grommets, or any other suitable fastener arrangement. Optional end flap 292, 392 extends from exit ramp 130, and preferably and conveniently may be buried in a transverse trough 755 in the snow or the earth near the ramp exit 130. Roller 750 may be stored in trough 755 with flap 292, 392 and typically both are covered to fill trough 755, e.g., with snow or earth, as the case may be. A roller 750 utilized in moving landing cushion 100 into container 600' need not be stored in trough 755, as may be convenient, but may be stored elsewhere.

Container 600' comprises an enclosure 610 having a top panel 612, a base panel 616, a front panel 614*a'* having an opening 615' through which rolled up deflated cushion 100 may be moved, a rear panel 614*b*, and end panels 618. Opening 615 may be coverable, and if so may optionally have a cover that is completely removable, or that is hinged to enclosure 610, or that retracts into or onto enclosure 610, or that is any other suitable cover, whether rigid or flexible. Container 600' further comprises a roll up arrangement 620' for moving deflated cushion 100 into container 600' and onto a roller or spool 626' therein having straps 628 wound thereon (illustrated as being wound thereon), and preferably includes various additional apparatus and utilities 650-690 for landing cushion 100, e.g., for inflating airbag 200, 300, 400, and for moving deflated airbag 200, 300, 400 into container 600'.

In FIG. 4B, cushion 100 is illustrated in a deflated condition, which could be either preceding the rolling (moving) of cushion 100 into container 600' or following the unrolling (moving) of cushion 100 out of container 600'. Prior to rolling cushion 100 into container 600', straps 628 are unrolled from spool 626' and the hooks 629 at the respective ends of straps 628 are engaged with rings 298, 398 at the ends of straps 294, 394 associated with cushion 100, specifically with the bottom 150 of cushion 100 and/or with the bottom 250, 350 of airbag 200, 300. Conversely, after cushion 100 is unrolled from container 600', hooks 629 and rings 298, 398 are disengaged and spool 626' may be rotated to wind straps 628 thereon.

Roll up arrangement 620' for moving landing cushion 100 into container 600' comprises roller or spool 626' onto which straps 628 (and possibly straps 294, 394 associated with cushion 100) are rolled or would be rolled so as to cause roller 750 to move towards container 600' and wind landing cushion 100 there around.

The opposing ends of spool 626' are preferably rotatably supported at the respective ends 618 of enclosure 610 or to suitable structure therein. As spool 626 is rotated and deflated cushion 100 is wound onto roller 750 and is drawn into container 600' the diameter of the rolled cushion 100 on spool 626' increases and so the height of opening 615' is substantial so that rolled cushion 100 may be moved therethrough. It is noted that the weight of roller 750 and any of landing cushion 100 wound thereon tends to compress cushion 100 which tends to press the air out of airbag 200, 300, 400, e.g., via vents 380 and tubes 370, 470, which is thought to naturally aid in providing a compact storage. The air in airbag 200, 300, 400 is preferably expelled therefrom prior to its being moved into container 600', which tends to be aided by the weight of airbag 200, 300, 400 and landing surface member 500.

In FIG. 4C, cushion 100 is illustrated in a deflated condition and partially rolled on roller 750, which could be either in the process of rolling (moving of) cushion 100 into container 600' or in the process of unrolling (moving of) cushion 100 out of container 600'. At this stage, strap 628 is partially wound on spool 626' and clasp 2948, 398, 629 is engaged, and any optional cover, if provided, for opening 615' is moved away. Container 600' is of sufficient size that all of cushion 100 wound around roller 750 fits therein.

Further features of container 600' are apparent from FIG. 5. Certain features of container 600', e.g., air supply tubes, electrical cables, and the like, are not shown for the sake of simplicity. Various apparatus and utilities 620'-695 may preferably be provided in container 600' of like type and kind to apparatus and utilities 650-695 of container 600 and so need not be shown or described again in relation to FIG. 5.

Spool 626' is preferably the spool of a winch. While such winch could be manually operated, it is preferred that the winch include a motor 660 by which spool 626' is rotated. Motor 660, preferably an electric motor, is coupled to spool 626' for causing spool 626' to rotate in the desired direction, whereby motor 660 and spool 626' comprise a winch. Preferably, motor 660 is coupled to spool 626' by a gear arrangement 670 that reduces the speed of rotation of motor 660 while increasing the torque at spool 626' for winding straps 294, 394 onto spool 626. Alternatively, a manual drive such as a crank could be employed to rotate spool 626' via gear arrangement 670 for moving cushion 100 into container 600', either without a motor 660 to assist or in conjunction with a motor 660.

Typically, landing cushion 100 is deployed, i.e. is moved out of container 600' and unrolled from roller 750, by pulling it through opening 615', e.g., by a tug, by a tractor, by a snowmobile, by manual labor, or by any other suitable method, e.g., by pulling straps 294, 394, 628 in a direction away from container 600'. Spool 626' may be freed to rotate so that strap 628 may unroll therefrom or that ring 298, 398 and hook 629 may be separated.

Optional heater 650, motor 660, gear arrangement 670, optional air supply 680, and optional electrical generator 690 may be similar to those described in relation to container 600 and so are not described again. All of the foregoing apparatus and utilities 620'-690 may be mounted on or to enclosure 610 of container 600' in any convenient location and manner, e.g., in like manner to that described in relation to container 600.

In an example enclosure 600' suitable for use with landing cushion 100 that is about 50 feet (about 15.2 meters) wide and 70 feet (about 21.3 meters) long at its base 150, container 600' is of like size and dimension to the example container 600 described above. However, opening 615' may be about 51-52 feet (about 15.5-15.8 meters) wide by about 6 feet (about 1.8 meters) high. Therewith, airbag 200, 300 has a flap 290, 390 at container end 160, 260, 360 that is about 50 feet (about 15.2 meters) wide and about 5 feet (about 1.5 meters) long, has a flap 292, 392 at exit end 130 that is about 50 feet (about 15.2 meters) wide and about 6 feet (about 1.8 meters) long, and flexible tubes 370, 470 may be about 12 feet (about 3.7 meters) and 8 feet (about 2.4 meters) long, respectively. Straps 294, 394 are typically about 4-inch (about 10 cm) wide woven webbing and extend about 12 feet (about 3.7 meters) from container end 160 and about 7 feet (about 2.1 meters) from exit end 130.

Figure 6A:
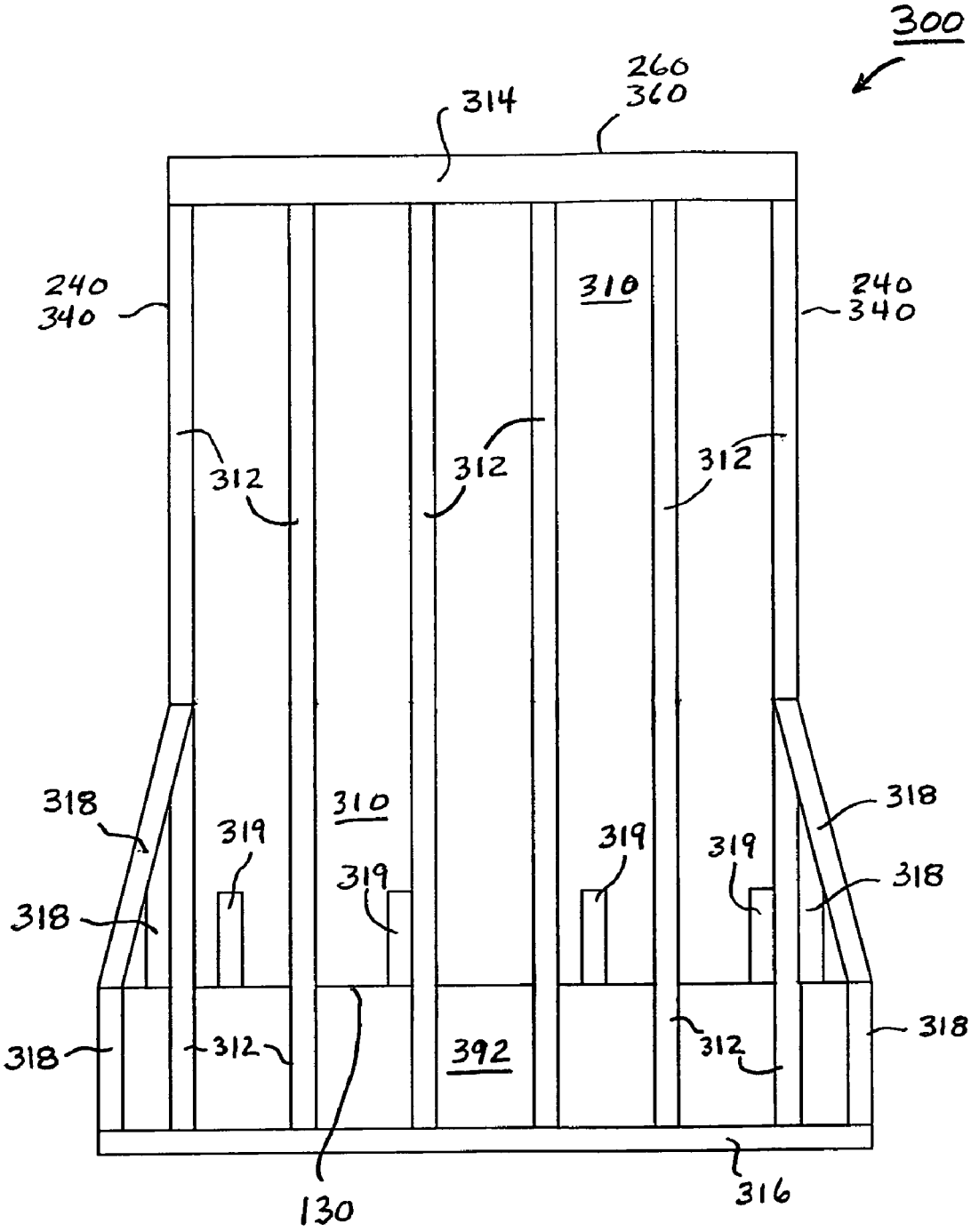
FIGS. 6A and 6B are plan view schematic diagrams of the top and bottom surfaces, respectively, of an example embodiment of an airbag useful with the landing cushion of FIGS. 1A-1B.
Figure 6B:
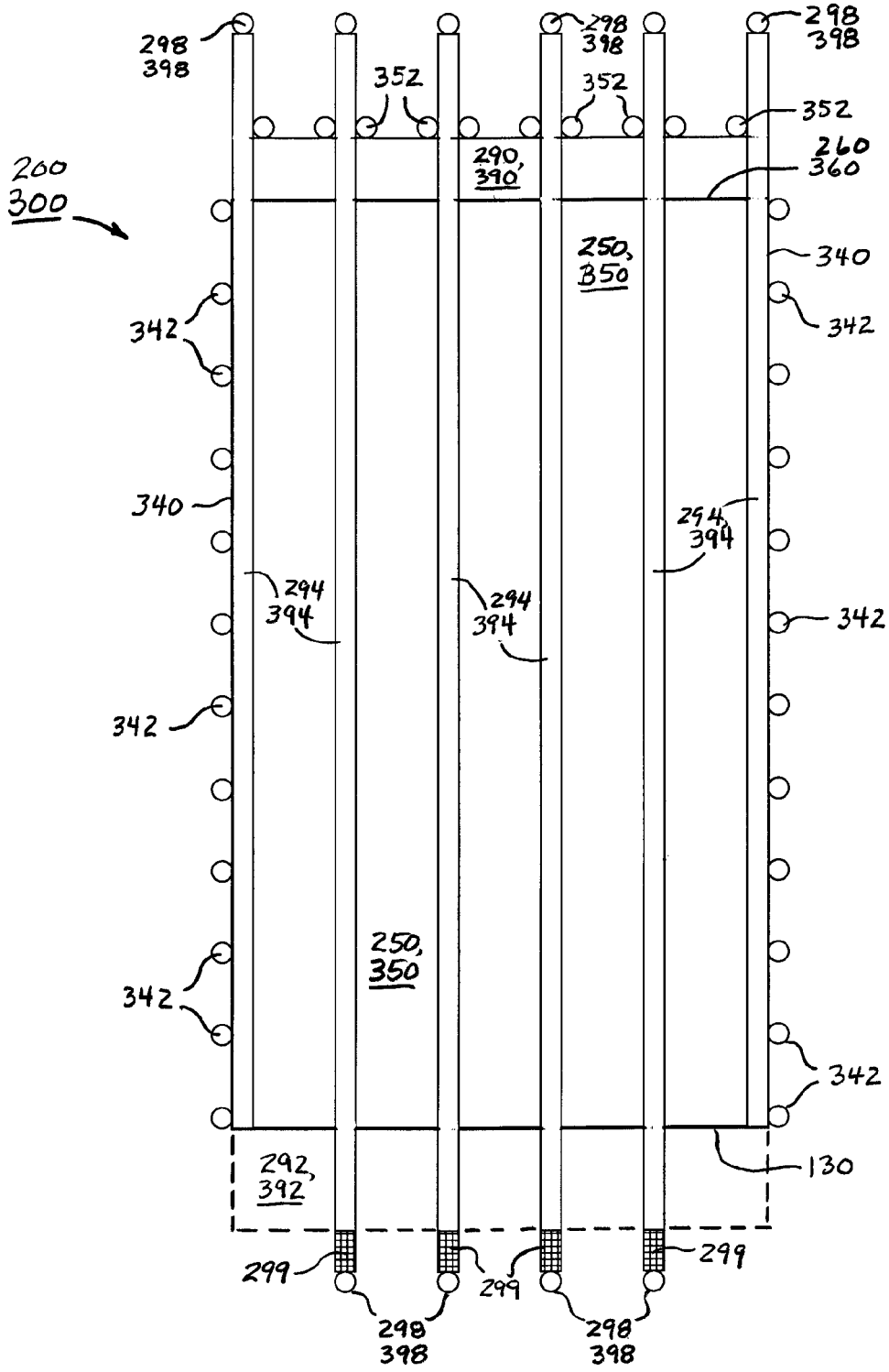

FIGS. 6A and 6B are plan view schematic diagrams of the top and bottom surfaces 310, 350, respectively, of an example embodiment of an airbag 300 useful with the landing cushion 100 of FIGS. 1A-1B. In FIG. 6A, the top surface 310 of example airbag 300 has a pattern of adhesive strips 312-318 thereon which are for adhering airbag 300 to a corresponding pattern of compatible adhesive strips on the bottom 450 of landing surface airbag 400.

For example, a plurality of longitudinal adhesive strips 312 are spaced apart on top surface 310, preferably with ones of strips 312 along the edges of top surface 310 at sides 340, and extending for the full length of airbag 300, including optional flap 392 if provided. Transverse adhesive strip 314 is provided along the container edge of top surface 310 and transverse adhesive strip 316 is provided along the opposing edge of optional flap 392. Top surface 310 is relatively narrower where corresponding to landing area 112 and widens out in the area corresponding to ramp 120 to ramp exit 130, and so adhesive straps 318 are provided on the outward portions of the area corresponding to ramp 120 and of optional flap 392. Adhesive strips 319 are provided for receiving excess length of straps 394 of airbag 300 so that they can be kept out of the way when not being utilized.

In one example embodiment, adhesive strips 312-318 are preferably the hook portion of a hook and loop fastener and are about 6 inches wide, except that strip 314 is about 12 inches wide. Adhesive strips 319 are preferably the loop portion of a hook and loop fastener and are about 6 inches wide. The ends of strips 312 may have the hook portion of hook and loop fastener on the opposing side thereof where they overlie optional flap 392. Preferably, strips 312 and 319 are relatively evenly spaced apart over top surface 310, and strips 312-319 may be sewn or adhesively attached thereto.

In FIG. 6B, the bottom surface 250, 350 of example airbag 200, 300 has a plurality of straps 394 and rings 342, 352 thereon which may be utilized, e.g., for handling airbag 200, 300 when deploying or moving it, or for securing airbag 200, 300 to the earth or snow or other surface upon which landing cushion 100 rests, or for securing flap 290, 390 within container 600, 600'. Rings 342, e.g., D-rings, may be attached to airbag 200, 300 spaced apart, preferably relatively evenly spaced, along the edge between bottom surface 250, 350 and sides 240, 340, and rings 352, e.g., D-rings, may be attached at the remote end of flap 290, 390 proximate the locations whereat straps 294, 394 extend therefrom.

For example, a plurality of longitudinal straps 394 are spaced apart on bottom surface 350, preferably with ones of straps 394 along the edges of bottom surface 350 at sides 240, 340, and others spaced therebetween, and extending beyond the full length of airbag 300, including flap 390 and optional flap 392 if provided. Each of straps 394 preferably has a ring 298, 398 at each end thereof, which rings are useful, e.g., some may be utilized for securing flap 290, 390 in container 600, 600' and some may be utilized for clasping with hook or clip 629 on strap 628 in the arrangement of FIGS. 4A-4C. The ends of straps 294, 394 at the ramp exit end 130 of airbag 200, 300 preferably have a piece 299 of the hook portion of hook and loop fastener thereon so that the ends of straps 294, 394 may be secured to strips 319 when not being utilized.

In one example embodiment of airbag 200, 300, straps 294, 394 are preferably about 4-inch wide webbing and extend about 12 feet (about 3.7 meters) beyond container end 260, 360 of airbag 200, 300, and extend about 7 feet (about 2.1 meters) beyond exit end 130 thereof. Straps 294, 394 are not sewn to bottom surface 250, 350, in the arrangement of FIGS. 4A-4C, but typically would not be sewn to optional flap 292, 392, however, in certain arrangements all or part of straps 294, 394 may be attached to bottom surface 250, 350 by a suitable detachable fastener, e.g., a hook and loop fastener. The portion of straps 394 that extend beyond exit end 130 and/or flap 292, 392 may be omitted or removed for the arrangement of FIGS. 2A-2C.

Figure 7A:
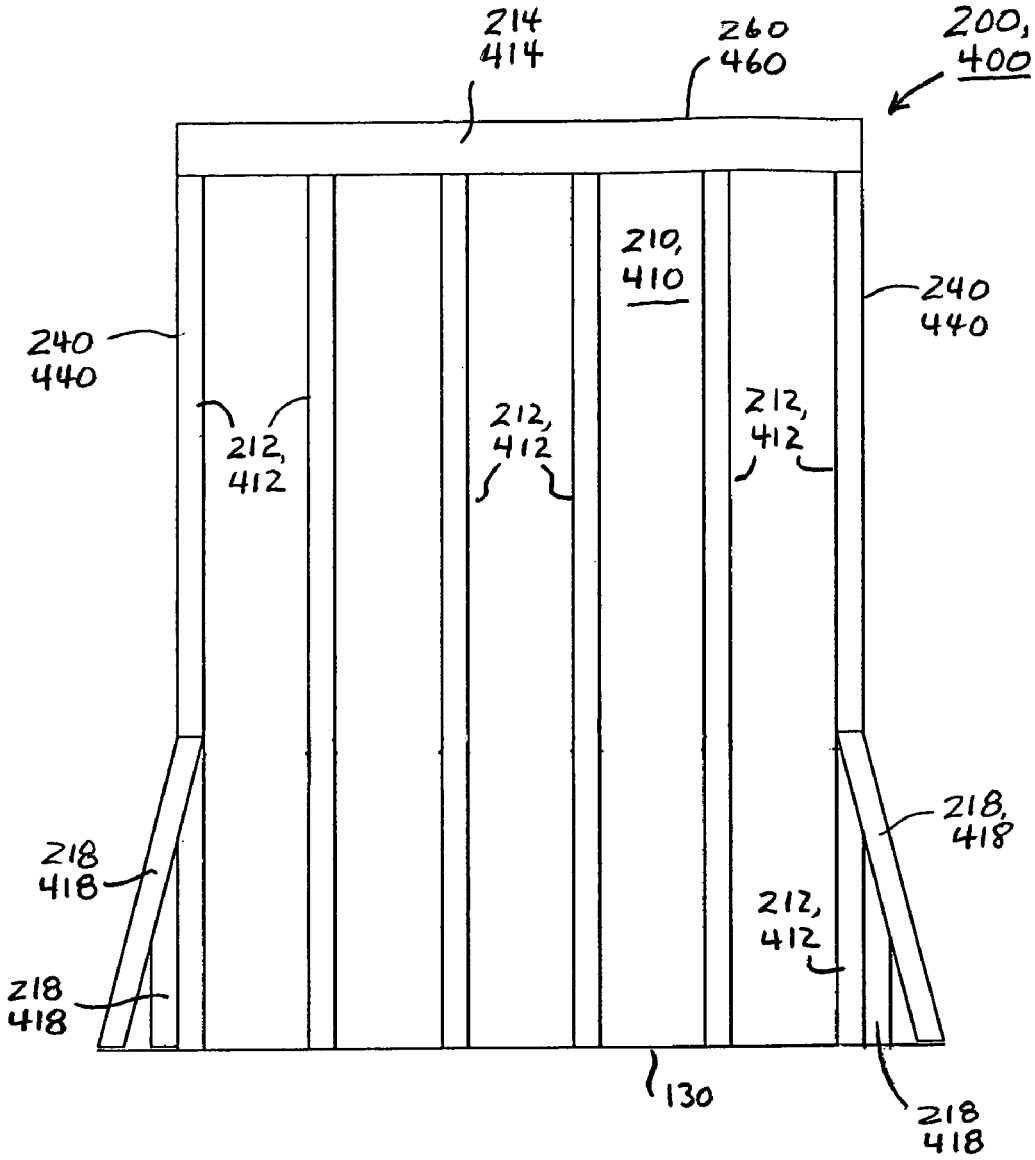
FIGS. 7A and 7B are plan view schematic diagrams of the top and bottom surfaces, respectively, an example embodiment of another airbag useful with of the landing cushion of FIGS. 1A-1B.
Figure 7B:
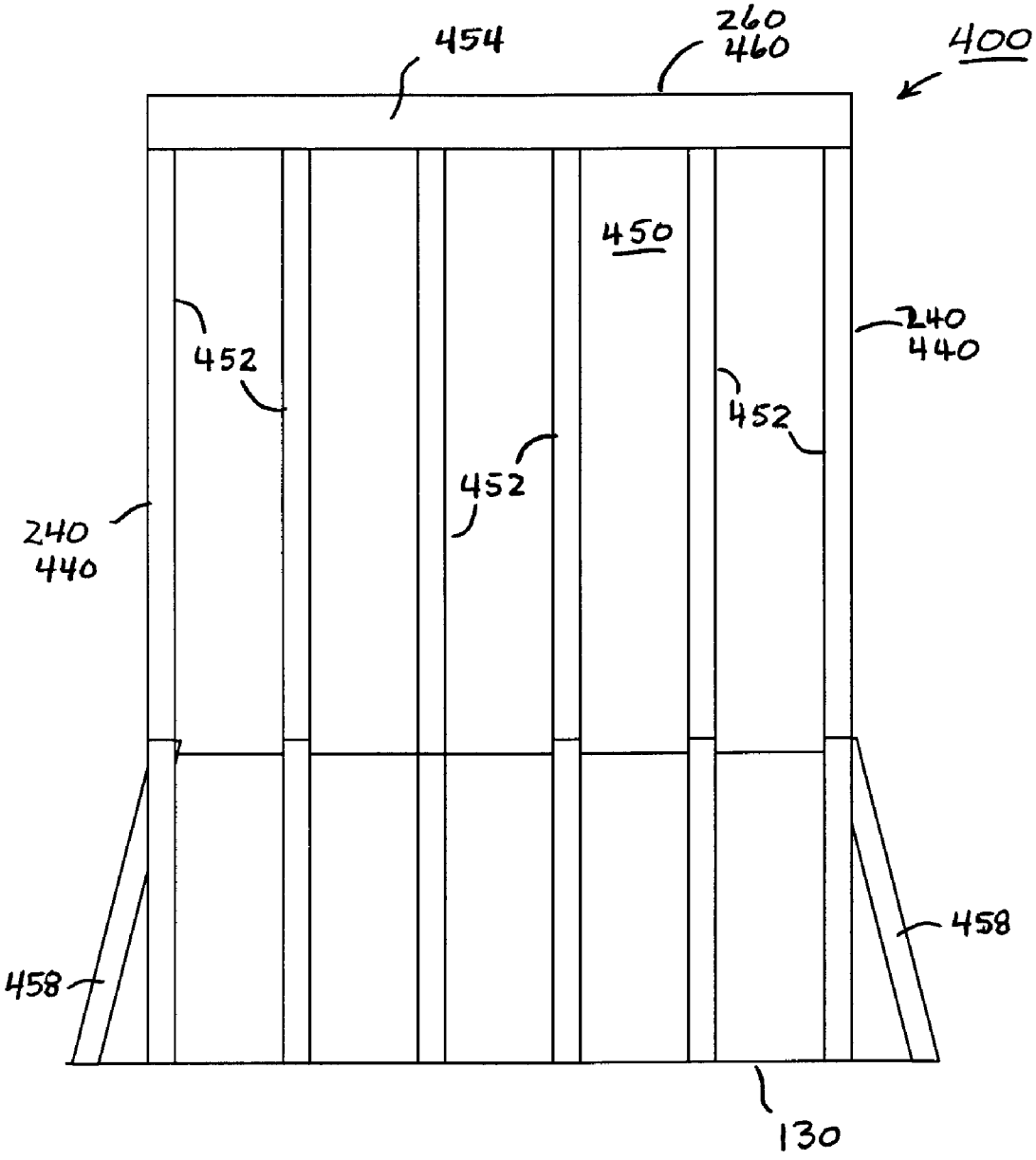

FIGS. 7A and 7B are plan view schematic diagrams of the top and bottom surfaces 410, 450, respectively, an example embodiment of an airbag 400 useful with of the landing cushion 100 of FIGS. 1A-1B. In FIG. 7A, the top surface 210, 410 of example airbag 200, 400 has a pattern of adhesive strips 412-418 thereon which are for adhering a corresponding pattern of compatible adhesive strips on the bottom of landing surface member 500 to airbag 200, 400.

For example, a plurality of longitudinal adhesive strips 312 are spaced apart on top surface 210, 410, preferably with ones of strips 212, 412 along the edges of top surface 210, 410 at sides 240, 440, and extending for the full length of airbag 200, 400. Transverse adhesive strip 214, 414 is provided along the container edge 240, 440 of top surface 210, 410. Top surface 210, 410 is relatively narrower where corresponding to landing area 112 and widens out in the area corresponding to ramp 120 to ramp exit 130, and so adhesive straps 218, 418 are provided on the outward portions of the area corresponding to ramp 120.

In one example embodiment, adhesive strips 212-218, 412-418 are preferably the hook portion of a hook and loop fastener and are about 6 inches wide, except that strip 214, 414 is about 12 inches wide. Preferably, strips 212, 412 are relatively evenly spaced apart over top surface 210, 410, and may be sewn or adhesively attached thereto.

It is noted that the bottom surface of landing surface member 500 will have an array of adhesive members, e.g., strips, that are in the same pattern as (see FIG. 7A) and are of complementary type to those of top surface 210, 410 of airbag 200, 400 so that landing surface member 500 may be placed onto the top surface 210, 410 of airbag 200, 400 and adhere thereto by their respective adhesive members. Airbag 200, 400 and landing surface member 500 preferably have complementary compatible hook and loop fastener strips thereon so as to removably adhere to each other. Where airbag 200, 400 has the hook portion of a hook and loop fastener thereon, landing surface member 500 will have the loop portion of hook and loop fastener thereon.

In FIG. 7B, the bottom surface 450 of example airbag 400 has a pattern of adhesive strips 452-458 thereon which are for adhering to a corresponding pattern of compatible adhesive strips on the top 310 of airbag 300.

For example, a plurality of longitudinal adhesive strips 452 are spaced apart on bottom surface 450, preferably with ones of strips 452 along the edges of bottom surface 450 at sides 240, 440, and extending for the full length of airbag 400. Transverse adhesive strip 454 is provided along the container edge 260, 460 of top surface 410. Top surface 410 is relatively narrower where corresponding to landing area 112 and widens out in the area corresponding to ramp 120 to ramp exit 130, and so adhesive strips 458 are provided on the outward portions of the area corresponding to ramp 120.

In one example embodiment, adhesive strips 452-458 are preferably the loop portion of a hook and loop fastener and are about 6 inches wide, except that strip 454 is about 12 inches wide. Preferably, strips 452 are relatively evenly spaced apart over bottom surface 450, and may be sewn or adhesively attached thereto.

It is noted that the bottom surface 450 of airbag 400 has an array of adhesive members, e.g., strips, that are complementary to those of top surface 310 of airbag 300 so that airbag 400 may be placed onto the top surface 310 of airbag 300 and be adhered thereto by their respective adhesive members. Airbags 300, 400 preferably have complementary compatible hook and loop fastener strips thereon so as to removably adhere to each other. Where top 310 of airbag 300 has the hook portion of a hook and loop fastener thereon, bottom 450 of airbag 400 will have the loop portion of hook and loop fastener thereon.

A sport landing cushion 100 may comprise: an airbag 200, 300, 400 comprising first and second inflatable compartments 300, 400, wherein the first compartment 300 is thicker than the second compartment 400 and provides a base, and wherein the second compartment 400 provides a landing surface 110 and is inflatable to a higher pressure for use than is the first compartment 300. A landing surface member 500 may be on the landing surface of second compartment 400 of airbag 200, 300, 400. Airbag 200, 300, 400 may be a unitary air bag 200 having the first and second inflatable compartments 300, 400 therein; or may comprise detachably attached first and second airbags 300, 400 providing the first and second inflatable compartments 300, 400; or may be a unitary air bag 200 having the first and second inflatable compartments 300, 400 therein, wherein the first compartment has a plurality of vents 340; or may comprise detachably attached first and second airbags 300 400 providing the first and second inflatable compartments 300, 400, wherein the first compartment 300 has a plurality of vents 340. Landing cushion 100 may further comprise a container 600, 600' into which airbag 200, 300, 400 may be moved when airbag 200, 300, 400 is not inflated. Container 600, 600' may include: a winch 620 for assisting in moving airbag 200, 300, 400 into container 600, 600'; or an air supply 680 for inflating airbag 200, 300, 400; or an air supply 680 for inflating the second compartment 400 of airbag 200, 300, 400 to a higher pressure than the first compartment 300 thereof; or a heater 650 for heating container 200, 300, 400; or any combination of the foregoing, and an optional electrical generator 690 for supplying electrical power to the winch 620, to the air supply 680 and/or to the heater 650, if provided in container 600, 600'. Airbag 200, 300, 400 may be wound around a spool 626 that is rotatable within container 600 or airbag 200, 300, 400 may be rolled onto a roller 750 and into container 600'. A sloped ramp 120 may extend from the landing surface of second compartment 400 of airbag 100 to a surface on which first compartment 300 of airbag 100 is resting, wherein the thickness of first compartment 300, the thickness of second compartment 400, or both, of airbag 100 is reduced to provide sloped ramp 120. A landing surface member 500 may be on the landing surface of second compartment 400 and on sloped ramp 120 of airbag 100.

Apparatus 100 for use in sports on which sports equipment and/or an athlete or operator thereof may land with an impact force after an aerial maneuver, apparatus 100 may comprise: an inflatable cushion 200, 300, 400 having a landing portion 110 and a ramp portion 120, and having a base compartment 300 and a landing surface compartment 400 over the base compartment 300; a landing surface member 500 disposed on the ramp portion 120 and on the landing portion 110 of the inflatable cushion 200, 300, 400; wherein the inflatable cushion 200, 300, 400 is inflatable to a selectable degree for use and is deflatable for storage; a container 600, 600' defining an enclosure 610 for storing the deflated inflatable cushion 200, 300, 400; and a mechanism 620 at least for moving the deflated inflatable cushion 200, 300, 400 into the container 600, 600'. Inflatable cushion 200, 300, 400 may have an internal baffle for defining the base and landing surface compartments 300, 400 thereof, or may include first and second separatable airbags 300, 400 defining the base and landing surface compartments 300, 400 thereof. Inflatable cushion 200, 300, 400 may have one or more vents 340 in the base compartment 300 thereof, or landing surface member 500 may be removably attached to inflatable cushion 200, 300, 400; or inflatable cushion 200, 300, 400 may have one or more vents 340 in the base compartment 300 thereof and landing surface member 500 may be removably attached to inflatable cushion 200, 300, 400. Container 600, 600' may include: a winch 620 for assisting in moving inflatable cushion 200, 300, 400 into container 600, 600'; or an air supply 680 for inflating inflatable cushion 200, 300, 400; or an air supply 680 for inflating the landing surface compartment 400 of inflatable cushion 200, 300, 400 to a higher pressure than the base compartment 300 thereof; or a heater 650 for heating container 600, 600'; or any combination of the foregoing, and an optional electrical generator 690 for supplying electrical power to the winch 620, to the air supply 680 and/or to the heater 690, if provided in container 600, 600'. Mechanism 620 may include: a spool 626 that is rotatable within container 600 for winding the deflated inflatable cushion 200, 300, 400 there around, whereby the deflated inflatable cushion 200, 300, 400 may be moved into container 600; or a spool 626' that is rotatable within container 600' for winding straps 294, 394 associated with the inflatable cushion 200, 300, 400 there around, whereby the deflated inflatable cushion 200, 300, 400 may be rolled by the straps 294, 394 onto a roller 750 and into container 600'.

A sport landing cushion container 600, 600' into which an inflatable airbag 200, 300, 400 may be retracted when not inflated, container 600, 600' may comprise: an enclosure 610, 610' of sufficient size to enclose a rolled deflated airbag 200, 300, 400, enclosure 610, 610' having an opening 615, 615' through which a deflated airbag 200, 300, 400 may pass; a winch 620 for assisting in moving the airbag 200, 300, 400 into the enclosure 610, 610'; and an air supply 680 for inflating the airbag 200, 300, 400 when the airbag 200, 300, 400 is not in the enclosure 600, 610'. Air supply 680 may be for inflating a second compartment 400 of an airbag 200, 300, 400 to a higher pressure than a first compartment 300 of the airbag 200, 300, 400. Landing cushion container 600, 600' may further comprise: a heater 650 for heating container 600, 600'; and/or an electrical generator 690 for supplying electrical power to the winch 620, the air supply 680 and/or the heater 650, if provided in container 600, 600'. Airbag 200, 300, 400 may be moved through the opening 615 in enclosure 610 and onto a spool 626 that is rotatable within enclosure 610, or airbag 200, 300, 400 may be rolled onto a roller 750 and moved through the opening 615' of enclosure 610'. Winch 620 may include: a spool 626 that is rotatable within enclosure 610 for winding the deflated inflatable cushion 200, 300, 400 there around, whereby the deflated inflatable cushion 200, 300, 400 may be moved into enclosure 610; or a spool 626' that is rotatable within enclosure 610' for winding straps 294, 394 associated with the inflatable cushion 200, 300, 400 there around, whereby the deflated inflatable cushion 200, 300, 400 may be rolled by the straps 294, 394 onto a roller 750 and into enclosure 610'.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

While the present invention has been described in terms of the foregoing example embodiments, variations within the scope and spirit of the present invention as defined by the claims following will be apparent to those skilled in the art. For example, while airbag 200 preferably comprises two airbags 300, 400, that are inflated to different pressures, airbag 200 may comprise a single airbag 200 that is divided into two different compartments 300, 400 therein, so as to have one airbag or compartment 300 inflated to a relatively lower pressure so as to be relatively soft and to have another airbag or compartment 400 inflated to a relatively higher pressure so as to be relatively stiff.

Adhesive fasteners are described for attaching airbags 300, 400 to each other and for attaching landing surface member 500 to airbag 200, 400, including chemical adhesives that may be permanent or that may be peelable or otherwise separable, and including hook and loop fasteners which are easily pulled apart for separating the elements for landing cushion 100, whether for storage, shipment, repair, maintenance, or any other purpose. However, other means for fastening, permanent or detachable, e.g., snaps, ties, belts and buckles, zippers, sewn fasteners, and the like, may be employed for fastening between airbags 300, 400 and between airbag 200 and landing surface 500, as may be convenient.

Other suitable supports for roller 626 within container 600 are contemplated, such as vertical guides on end panels 618 in which the opposing ends of spool 626 may move up and down vertically as the diameter of the cushion 100 wound on spool 626 increases and decreases. Further, pivot arm 522 may be mounted to front panel 614*a* or in any other suitable manner within container 600.

While hooks 629 and rings 298, 398 are described as an example of a clasp for engaging and disengaging the respective ends or straps 628 and 294, 394, such hooks and rings may be reversed so that rings are on straps 628 and hooks are on straps 294, 394, and clips or any other suitable clasping and/or connecting arrangement may be utilized.

A connecting device may be employed for connecting flexible tubes 370, 470 to air supply 680, e.g., quick release connectors, tightenable bands, bolted connectors, threaded connectors, and the like. Airbag 200, 300 may be attached within container 600 by any suitable connector, e.g., to spool 626 and/or to enclosure 610, such as by bolts, clamps, clamping strips, hooks, hook and loop fasteners, snaps, buttons, and the like.

Finally, numerical values stated are typical or example values, are not limiting values, and do not preclude substantially larger and/or substantially smaller values. Values in any given embodiment may be substantially larger and/or may be substantially smaller than the example or typical values stated. For example, if a landing cushion were intended for use in a sport wherein participants typically move with a greater forward speed, the length of the landing surface and the supporting airbag(s) therefor could be increased accordingly to accommodate the expected landing patterns for typical participants, as could the width of the landing surface and the supporting airbag(s) therefor.

What is claimed is:

1. A sport landing cushion for use in sports on which sports equipment and/or an athlete or operator thereof may land with an impact force after an aerial maneuver comprising:

an airbag comprising first and second inflatable compartments, wherein the first compartment is thicker than the second compartment and provides a base, wherein the second compartment provides a landing surface and is disposed on top of the first compartment, and wherein the second compartment is inflated to a higher pressure for use than is the first compartment, thereby to provide a relatively stiffer upper second compartment and a relatively softer bottom first compartment; and a landing surface member on the landing surface of said second compartment of said airbag, wherein said landing surface member includes artificial turf providing a landing surface on which sport apparatus can land and move, thereby sports equipment and/or athlete or operator thereof may land and be supported thereon after an aerial maneuver and may move on the landing surface member.

2. The landing cushion of claim 1, wherein:

said airbag is a unitary air bag having the first and second inflatable compartments therein; or said airbag comprises detachably attached first and second airbags providing the first and second inflatable compartments; or said airbag is a unitary air bag having the first and second inflatable compartments therein, wherein the first compartment has a plurality of vents; or said airbag comprises detachably attached first and second airbags providing the first and second inflatable compartments, wherein the first compartment has a plurality of vents.

3. The landing cushion of claim 1, further comprising a sloped ramp extending from the landing surface of said second compartment of said airbag to a surface on which said first compartment of said airbag is resting, wherein the thickness of said first compartment, the thickness of said second compartment, or both, of said airbag is reduced to provide said sloped ramp.

4. The landing cushion of claim 3, wherein the landing surface member covers the sloped ramp of said airbag.

5. The landing cushion of claim 1, further comprising a container into which said airbag may be moved when said airbag is not inflated.

6. The landing cushion of claim 5, wherein said container includes:

a winch for assisting in moving said airbag into said container; or an air supply for inflating said airbag; or an air supply for inflating the second compartment of said airbag to a higher pressure than the first compartment thereof; or a heater for heating said container; or any combination of the foregoing.

7. The landing cushion of claim 6, wherein said container further includes an electrical generator for supplying electrical power to the winch, to the air supply, and to the heater, if provided in said container.

8. The landing cushion of claim 6, wherein said airbag may be wound around a spool that is rotatable within said container or wherein said airbag may be rolled onto a roller and into said container.

9. An apparatus for use in sports on which sports equipment and/or an athlete or operator thereof may land with an impact force after an aerial maneuver, the apparatus comprising:

an inflatable cushion having a landing portion and a ramp portion, and having a lower relatively thicker base compartment and an upper relatively thinner landing surface compartment over the base compartment;

a landing surface member disposed on the ramp portion and on the landing portion of the inflatable cushion, wherein the landing surface member includes artificial turf providing a surface on which sports apparatus and/or an athlete or operator thereof can land and move;

wherein the inflatable cushion is inflatable to a selectable degree for use and is deflatable for storage, wherein the upper relatively thinner landing compartment is inflated to a relatively higher pressure for use and the lower relatively thicker base compartment is inflated to a relatively lower pressure for use;

a container defining an enclosure for storing the deflated inflatable cushion; and a mechanism at least for moving the deflated inflatable cushion into the container.

10. The apparatus of claim 9, wherein:

said inflatable cushion has an internal baffle for defining the base and landing surface compartments thereof; or said inflatable cushion includes first and second separatable airbags defining the base and landing surface compartments thereof.

11. The apparatus of claim 9, wherein:

said inflatable cushion has one or more vents in the base compartment thereof; or said landing surface member is removably attached to said inflatable cushion; or said inflatable cushion has one or more vents in the base compartment thereof and said landing surface member is removably attached to said inflatable cushion.

12. The apparatus of claim 9, wherein the landing surface compartment of said inflatable cushion is inflated to a higher pressure for use than is the base compartment thereof.

13. The apparatus of claim 9, wherein said container includes:

a winch for assisting in moving said inflatable cushion into said container; or an air supply for inflating said inflatable cushion; or an air supply for inflating the landing surface compartment of said inflatable cushion to a higher pressure than the base compartment thereof; or a heater for heating said container; or any combination of the foregoing.

14. The apparatus of claim 13, wherein said container further includes an electrical generator for supplying electrical power to the winch, to the air supply and/or to the heater, if provided in said container.

15. The landing cushion of claim 9, wherein said mechanism includes:

a spool that is rotatable within said container for winding the deflated inflatable cushion there around, whereby the deflated inflatable cushion may be moved into said container; or a spool that is rotatable within said container for winding straps associated with the inflatable cushion there around, whereby the deflated inflatable cushion may be rolled by the straps onto a roller and into said container.

16. A sport landing cushion container into which an inflatable airbag may be retracted when not inflated, said container comprising:

an enclosure of sufficient size to enclose a rolled deflated airbag, the airbag comprising:

first and second inflatable compartments, wherein the first compartment is thicker than the second compartment and provides a base, wherein the second compartment provides a landing surface and is disposed on top of the first compartment, and wherein the second compartment is inflated to a higher pressure for use than is the first compartment, thereby to provide a relatively stiffer upper second compartment and a relatively softer bottom first compartment; and a landing surface member on the landing surface of the second compartment of said airbag, wherein the landing surface member includes artificial turf providing a landing surface on which sport apparatus can land and move, said enclosure having an opening through which a deflated airbag may pass;

a winch for assisting in moving the airbag into the enclosure; and an air supply for inflating the airbag when the airbag is not in the enclosure.

17. The landing cushion container of claim 16, wherein said air supply is for inflating a second compartment of an airbag to a higher pressure than a first compartment of the airbag.

18. The landing cushion container of claim 16, further comprising:

a heater for heating said container; or an electrical generator for supplying electrical power to the winch and to the air supply; or a heater for heating said container and an electrical generator for supplying electrical power to the winch, to the air supply and to the heater.

19. The landing cushion container of claim 16, wherein an airbag may be moved through the opening in said enclosure and onto a spool that is rotatable within said enclosure or wherein an airbag is rolled onto a roller and is moved through the opening of said enclosure.

20. The landing cushion container of claim 16, wherein said winch includes:

a spool that is rotatable within said enclosure for winding the deflated inflatable cushion there around, whereby the deflated inflatable cushion may be moved into said enclosure; or a spool that is rotatable within said enclosure for winding straps associated with the inflatable cushion there around, whereby the deflated inflatable cushion may be rolled by the straps onto a roller and into said enclosure.

21. The landing cushion of claim 1, wherein the landing surface member is removably attached to the second compartment of the airbag.

* * * * *